US006675494B1

(12) United States Patent
Oechsle et al.

(10) Patent No.: US 6,675,494 B1
(45) Date of Patent: Jan. 13, 2004

(54) SYSTEM FOR DRYING A WEB AND PROCESS

(75) Inventors: Markus Oechsle, Bartholomae (DE); Frank Wegehaupt, Böhmenkirch (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 166 days.

(21) Appl. No.: 09/452,157

(22) Filed: Dec. 1, 1999

(30) Foreign Application Priority Data

Dec. 4, 1998 (DE) ..... 198 55 940

(51) Int. Cl.[7] ..... F26B 3/34

(52) U.S. Cl. ..... 34/245; 34/381; 34/445; 34/459

(58) Field of Search ..... 34/245, 380, 381, 34/445, 459, 525, 528, 529, 60, 90, 113, 117, 122, 124, 618, 629; 162/109, 115, 135, 146; 101/424.1, 484, 488; 156/184, 191, 205

(56) References Cited

U.S. PATENT DOCUMENTS

| | | | | |
|---|---|---|---|---|
| 3,731,520 A | | 5/1973 | Hickman et al. | |
| 4,206,258 A | * | 6/1980 | Balcar | 34/95 X |
| 4,271,347 A | | 6/1981 | Svenson | |
| 4,738,752 A | | 4/1988 | Busker et al. | |
| 4,874,469 A | | 10/1989 | Pulkowski et al. | |
| 4,991,506 A | | 2/1991 | Rodi | |
| 5,060,572 A | * | 10/1991 | Waizmann | 101/424.1 |
| 5,115,741 A | | 5/1992 | Rodi | |
| 5,177,877 A | * | 1/1993 | Duchesne et al. | 34/467 |
| 5,416,980 A | * | 5/1995 | Ilvespaa | 34/117 |
| 5,443,691 A | * | 8/1995 | Phan et al. | 162/115 |
| 5,529,664 A | * | 6/1996 | Trokhan et al. | 162/109 |
| 5,851,352 A | * | 12/1998 | Vinson et al. | 162/112 |
| 5,921,002 A | | 7/1999 | Scheufler et al. | |
| 6,170,427 B1 | | 1/2001 | Scheufler et al. | |

FOREIGN PATENT DOCUMENTS

| | | |
|---|---|---|
| CH | 639800 | 11/1983 |
| DE | 3828753 | 3/1990 |
| DE | 19533673 | 3/1997 |
| EP | 0258169 | 3/1988 |
| GB | 1209335 | 10/1970 |
| WO | 98/31474 | 7/1998 |

OTHER PUBLICATIONS

JP Patent Abstract 59–133058. Jul. 1984.
JP Patent Abstract 07144403. Jun. 1995.

* cited by examiner

*Primary Examiner*—Stephen Gravini
(74) *Attorney, Agent, or Firm*—Greenblum & Bernstein, P.L.C.

(57) ABSTRACT

A process for drying a web provides for guiding a web having a moisture content and subjecting the web to laser radiation to remove at least some portion of the moisture content. A system for drying a web includes at least one laser, a moisture measurement device, and a control device, wherein the control device receives input from the measurement device and influences the at least one laser.

58 Claims, 1 Drawing Sheet

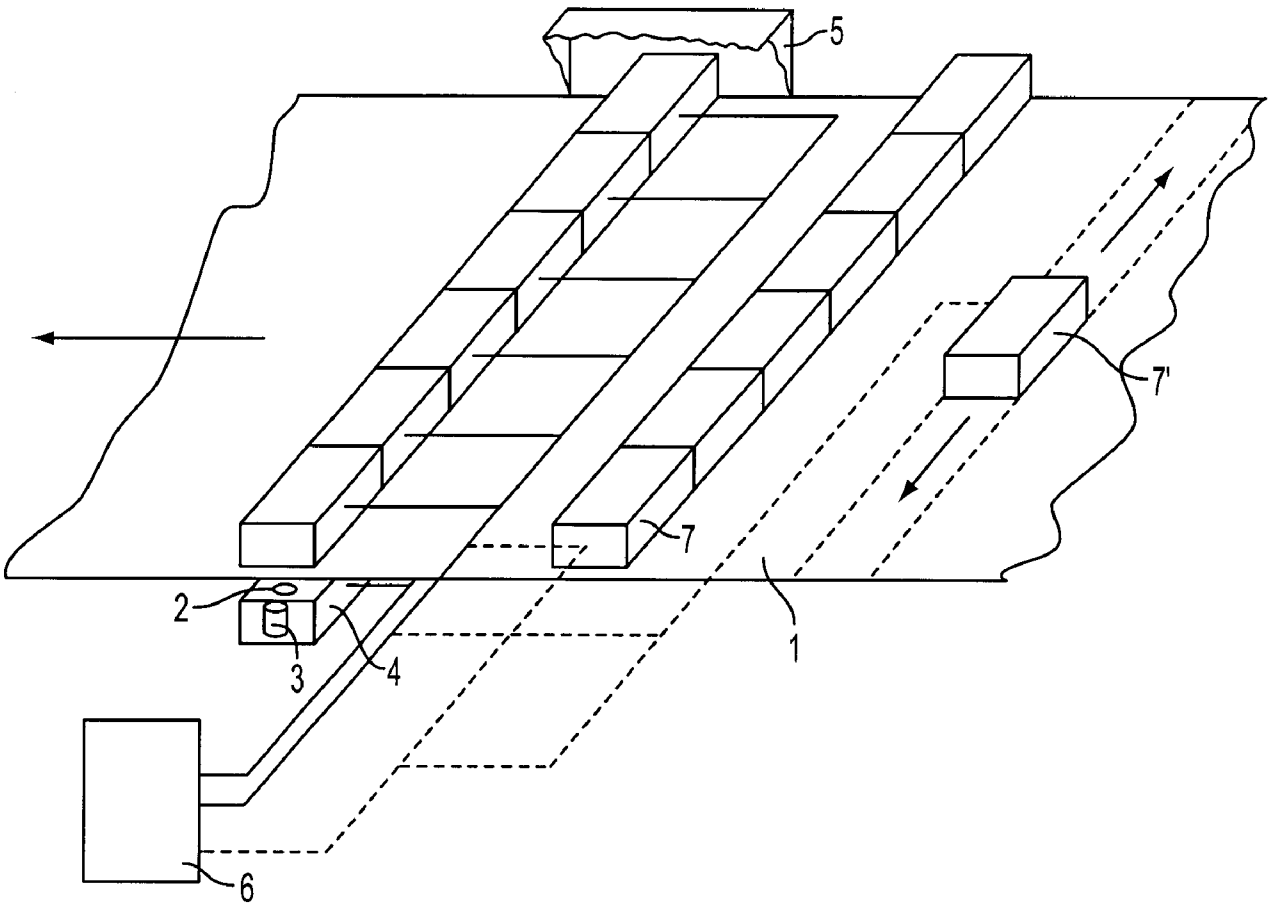
FIGURE

SYSTEM FOR DRYING A WEB AND PROCESS

CROSS-REFERENCE TO RELATED APPLICATIONS

The present application claims priority under 35 U.S.C. § 119 of German Patent Application No. 198 55 940.2, filed on Dec. 4, 1998.

BACKGROUND OF THE INVENTION

1. Field of the Invention

The invention relates to a process as well as a system for drying a fibrous material web, in particular a paper, tissue, or cardboard web.

2. Discussion of Background Information

Currently, fibrous material webs are dried by guiding them over heated cylinders. This technique is expensive in terms of space requirements and energy consumption. Additionally, it has the disadvantage of producing an uneven distribution of moisture laterally across the fibrous material web. In order to correct this moisture cross profile, conventional techniques employ additional moistening or heating steps which are applied to particular zones of the web. Many techniques even involve heating by induction through the use of infrared emitters or by employing steam. However, these corrective measures have produced unsatisfactory results and they suffer from their own disadvantages, such as an inability to heat relatively large zone widths; an inability to control heating at precise zones such as boundaries; and an inability to deliver heat efficiently as a result of their low energy transmission density. In addition, there is the danger of fire associated with, for example, infrared emitters. Finally, they all suffer from high energy use in terms of how much heat actually reaches the web and the moisture contained therein.

SUMMARY OF THE INVENTION

The invention is directed to a process and a system for drying a fibrous material web more efficiently. Such a process and system should ideally conserve space and have favorable efficiency in terms of delivering heat to where it is needed. It should also permit a high energy density to be transmitted to the web. Finally, it should afford control in delivering heat to specific zones on the web so as to positively influence the moisture cross profile of the web.

The invention includes subjecting the fibrous material web to laser radiation whose frequency is preferably set so that the laser radiation is mostly absorbed by the water or moisture of the web so that little of this energy is absorbed by the other components of the fibrous material web.

Laser radiation permits a high energy density to be transmitted and delivered to small and precisely defined zones on the web. This ability allows for controlling the moisture cross profile, across the fibrous material web. Moreover, all the drying can take place in a single stage of production if desired, rather that in multiple steps.

Since a significant portion of the energy is absorbed by the moisture, the efficiency is improved considerably. Furthermore, such a design allows for the more simplified delivery of greater amounts of heat without the danger of damaging the web. This is done simply by adjusting the laser radiation output so as to produce higher energy densities. One disadvantage of conventional drying via heated cylinders is that, as the moisture decreases, there is a corresponding drop in efficiency. However, the invention is essentially immune from this since if there is less moisture than less heat is absorbed by it. As a result, excessive heating of the web material itself is prevented.

If necessary however, some heating of the fibers may also be acceptable. In this case the range of suitable frequencies may be broadened and tailored to the needs of the particular web.

In order to influence the moisture cross profile, the intensity of the laser radiation should be controllable zone by zone and cross-wise (laterally) to the fibrous material web. To this end, it is advantageous for the area which is influenced by the laser radiation to be controllable in any number of directions. Precise control across and along the web length is specifically desired, since doing so permits an increase or change in the power to be transmitted while maintaining a constant energy density area.

The invention also provides for limiting the laser radiation to particular regions of the fibrous material web, for example at the edges. Thus edges of a web which are particularly wet may be subjected to greater drying in these zones. The system should also have the ability to control each laser in the array individually and independently. Moreover, system should also have the ability to turn off the laser when it is detected that the fibrous material web is torn.

In order to realize the control of the laser radiation by zone by zone, it is necessary at least to fix several lasers across the width of the fibrous material web. These should be arranged side by side and laterally to the fibrous material web in the form of an array.

The system may furthermore be used on free draws for delivering a high energy density as well as a relatively uniform action of the fibrous material web. This can be provided by arranging the lasers on both sides of the fibrous material web.

In order to protect the surrounding area, in particular the working area of operating personnel, the system should include shielding. Furthermore, if the lasers are set to produce non-visible laser radiation, then the system should also include at least one visible light source in a line with these non-visible lasers so that their operation can be observed. Such sources may be positioned in any number of locations. Moreover, they ay also be used to control the direction of the lasers.

According to one aspect of the invention there is provided a process for drying a fibrous material web including guiding the fibrous material web and subjecting the fibrous material web to laser radiation. The web may be one of a paper, tissue, and cardboard web. The frequency of the laser radiation may be set so that a moisture content of the fibrous material absorbs more laser radiation than the other components of the fibrous material web. The subjecting may also include separately controlling by zone a laser radiation intensity laterally across the fibrous material web. Moreover, the subjecting may further include controlling an area influenced by the laser radiation in a longitudinal direction of the fibrous material web. The reach of a radiated area of a zone may also be controlled laterally to the fibrous material web.

The invention also provides a switching off the laser radiation when a tear in the fibrous material web is detected, the subjecting to occur predominantly at an end of a drying process, and wherein the subjecting results in evening out a moisture cross profile of the fibrous material web.

According to another aspect of the invention there is provided a process for drying web which includes guiding a web having a moisture content and subjecting the web to laser radiation to remove at least some portion of said moisture content. The web may be one of a paper, tissue, and cardboard web. The process may further include continuously guiding the web and continuously subjecting the web to laser radiation. The process may also include determining the moisture content and controlling the laser radiation in response to this determining. The process preferably provides for heating the moisture content to a greater extent than the web and the heating reduces the moisture content.

The process may also provide that laser radiation is infra-red radiation, preferably the laser radiation is set to a wavelength of at least one of approximately 1.92 $\mu$m, 1.60 $\mu$m and 1.48 $\mu$m.

The process also provides for the subjecting being performed by an array of lasers arranged laterally across a portion of the web. The array may have the form of a plurality of lasers arranged in a row. Each laser in row may be individually and independently adjusted. The adjusting may correspond to a frequency of radiation emitted and/or to discontinuing the laser radiation. The process may also provide for a controlled amount of radiation to at least one longitudinal zone of the web. Alternatively, the process may provide for a controlled amount of radiation to a plurality of longitudinal zones of the web. The process may further include varying the controlled amounts so that different zones of said web receive different amounts of radiation.

The process also contemplates detecting a tear in the web and stopping the subjecting in response to this detecting. The process may further include preventing the laser radiation from impacting objects other than said web.

According to another aspect of the invention the process further includes measuring a moisture content of the web, communicating the measuring to a control device, and adjusting the subjecting with the control device. The measuring may further include providing a controlled amount of laser radiation to at least one longitudinal zone of the web.

In yet another aspect of the invention there is provided a device for drying a fibrous material web which includes a number of lasers arranged next to one another laterally to the fibrous material web which are fixed in relation to the fibrous material web. The device may have a number of lasers arranged on both sides of the fibrous material web. A shield may be located in a region of the lasers for shielding lasers. Moreover, at least one visible light source may be arranged adjacent the number of lasers.

The invention also provides for a system for drying a web which includes at least one laser, moisture measurement device, and a control device. The control device being capable of receiving input from the measurement device and influencing the at least one laser. The control device may control a laser radiation output of the at least one laser. The control device may further control an array of lasers. The at least one laser may produce infra-red laser radiation, preferably the laser radiation is set to a wavelength of at least one of approximately 1.92 $\mu$m, 1.60 $\mu$m and 1.48 $\mu$m.

The system may allow the control device to adjust the laser radiation emitted by the at least one laser in response the measuring device. Furthermore, the at least one laser may be an array of lasers, wherein the array is arranged laterally across a portion of the web. Alternatively, the at least one laser may be a first laser arranged on one side of the web and a second laser arranged on another side of the web. Additionally, the first laser and said second laser each may be an array of lasers. Moreover, each array may be arranged laterally across a portion of the web.

The system may also have a radiation shield arranged adjacent the web for preventing an escape of laser radiation. At least one visible light source may also be arranged adjacent the at least one laser. Alternatively, the at least one visible light source may be arranged adjacent the array.

The invention also provides for a process for drying a fibrous material web which includes continuously guiding a fibrous material web having a moisture content, measuring the moisture content, communicating the measuring to one of a control device and an array of lasers, and subjecting the web to a controlled amount of infra-red laser radiation in order to reduce the moisture content, monitoring the web for tearing so that the laser radiation is discontinued when a tear is detected. The laser radiation may be set to a frequency range which in which more energy is absorbed by the moisture than by the web.

According to another aspect of the invention there is provided a system for drying a web which includes a control device, a plurality of lasers arranged in an array across a width of the web, a measurement device for determining a moisture content in the web, such that the measuring device coupled to one of the control device and the laser array, a shield for preventing escape of laser radiation, and a device for detecting a tear in the web. The system provides for the control device to influence a laser output of the array in order to produce a change in the moisture content of the web, such that the laser radiation is set to a frequency range which in which more energy is absorbed by the moisture than by the web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

The sole FIGURE shows a schematic representation of the device according to the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings marking apparent to those skilled in the art how the several forms of the present invention may be embodied in practice.

The system uses a number of lasers 2 which are arranged in the form of an array. The array is preferably positioned laterally across fibrous material web 1 with each laser directed to a particular zone of the web. The FIGURE shows an array positioned on both sides of web 1, and arranged opposite one another in relation to web 1. Each array is made up of an interconnected row of lasers 2 extending across the width of web 1, with each array being separately controllable. Each array is also connected to a control unit 6 by way of corresponding control lines and energy lines.

In order to protect the surrounding area, a shield 5 is employed. Moreover, the system uses a visible light source 3, e.g., an LED or other light indicating device, shown here adjacent a single laser in the bottom array, in order to indicate the function and acting direction of a laser 2.

The system may be arranged at the end of the drying section of a machine for producing or refining a fibrous material web 1 and may be used to even out and/or control the moisture cross profile of web 1. The system may also be used to dry a web coming off a roll. Furthermore, the system may be located in any convenient location where web drying is desired.

The intensity of laser radiation should be controllable across the width of the fibrous material web 1. That is, each laser is positioned to influence a particular zone of the web. Moreover, the system is controllable to provide different radiation amounts to these different zones depending on their specific requirements. For example, zones containing more moisture will receive more radiation per unit area and thus will be heated to a greater extent than zones which contain less moisture. Thus, the array can influenced the entire web zone by zone and in a controlled manner. Preferably, the amount of energy delivered should be a function of a measured moisture cross profile of the fibrous material web. 1. For this purpose, any number of conventionally known measurement devices may be utilized. Moreover, the measurement device 7 may be arranged at any convenient position for measuring the moisture content of the web. Measurement device 7 may be formed by a stationary measuring device that extends across the width of the web 1, and the stationary measuring device can be sub-divided into a plurality of zones which correspond to laser array zones 4. Further still, a single moving measurement device 7' may be employed that traverses the width of the web 1. This arrangement can also allow for the heating of specific zones and the not heating of others. For example, if the user desires to influence only the edges, then the lasers which are not at the edges may be turned off. Furthermore, the system provides that all of the lasers 2 can be switched off if the web tears. For this purpose, any number of conventional devices for detecting a tear in the web may be employed.

Lasers 2 have a very short reaction time and offer the possibility for transmitting large quantities of energy to a precisely defined area of the fibrous material web 1. The frequency of the laser radiation can be set so that the laser radiation is predominantly absorbed by the water of the fibrous material web 1. In the exemplary embodiment, lasers 2 may be set to operate, e.g., in the infra-red frequency range, and particularly set to wavelengths of approximately 1.92 $\mu$m, approximately 1.60 $\mu$m and/or approximately 1.48 $\mu$m. Other settings are also contemplated depending on factors such as efficiency, moisture content, web types and radiation wavelength absorption characteristics of the designed elements of the web.

Moreover, if no free draw is present, i.e., because the fibrous material web 1 is supported by a roll and/or a belt, then the lasers 2 of a single array should be arranged on the free side of the fibrous material web 1.

Control unit 6 may operate to merely turn on and off the individual lasers or may be utilized to adjust each laser's output. A device for detecting a tear in the web (not shown) may be connected to either the lasers directly or via control unit 6. This detecting device (not shown) may also be located adjacent lasers 2 or at any position along the web. Moreover, measuring device 7 may provide input to either the control unit 6 or each individual laser 2. Measuring device 7 may additionally be located adjacent the lasers 2 or at any position along the web where it can taken proper measurements.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for drying a fibrous material web to control a moisture cross profile in the web, the process comprising:

guiding said fibrous material web; and subjecting said fibrous material web to laser radiation in order to control the moisture cross profile of said fibrous material web.

2. The process of claim 1, wherein the web is one of a paper, tissue, and cardboard web.

3. The process of claim 1, further comprising:

setting a frequency of said laser radiation so that a moisture content of said fibrous material absorbs more laser radiation than other components of said fibrous material web.

4. The process of claim 1, wherein said subjecting further comprises:

separately controlling by zone a laser radiation intensity laterally across said fibrous material web.

5. The process of claim 1, wherein said subjecting further comprises:

controlling an area influenced by said laser radiation in a longitudinal direction of said fibrous material web.

6. The process of claim 4, wherein a reach of a radiated area of a zone is controlled laterally to said fibrous material web.

7. A process for drying a fibrous material web to control a moisture cross profile in the web, the process comprising:

guiding said fibrous material web;

subjecting said fibrous material web to laser radiation in order to control the moisture cross profile of said fibrous material web; and switching off said laser radiation when a tear in said fibrous material web is detected.

8. A process for drying a fibrous material web to control a moisture cross profile in the web, the process comprising:

guiding said fibrous material web; and subjecting said fibrous material web to laser radiation in order to control the moisture cross profile of said fibrous material web, wherein said subjecting occurs predominantly at an end of a drying process.

9. The process of claim 1, wherein said subjecting results in evening out a moisture cross profile of said fibrous material web.

10. A process for drying a web to control a moisture cross profile in the web, the process comprising:

guiding a web having a moisture content; and subjecting said web to laser radiation to remove at least some portion of said moisture content in order to control the moisture cross profile of said web.

11. The process of claim 10, wherein said web is one of a paper, tissue, and cardboard web.

12. The process of claim 10, further comprising:

continuously guiding said web; and continuously subjecting said web to laser radiation.

13. The process of claim 10, further comprising determining said moisture content and controlling said laser radiation in response to said determining.

14. The process of claim 13, further comprising;

heating said moisture content to a greater extent than said web.

15. The process of claim 14, wherein said heating reduces said moisture content.

16. The process of claim 13, wherein said laser radiation is infra-red radiation.

17. A process for drying a web to control a moisture cross profile in the web, the process comprising:

guiding a web having a moisture content;

subjecting said web to laser radiation to remove at least some portion of said moisture content in order to control the moisture cross profile of said web; and determining said moisture content and controlling said laser radiation in response to said determining, wherein said laser radiation is set to a wavelength of at least one of approximately 1.92 $\mu$m, 1.60 $\mu$m and 1.48 $\mu$m.

18. The process of claim 10, wherein said subjecting is performed by an array of lasers arranged laterally across a portion of said web.

19. The process of claim 18, wherein said array comprises a plurality of lasers arranged in a row.

20. The process of claim 19, further comprising adjusting each laser in said row.

21. The process of claim 20, wherein said adjusting corresponds to a frequency of radiation emitted.

22. The process of claim 20, wherein said adjusting corresponds to discontinuing laser radiation.

23. The process of claim 10, wherein said subjecting further comprises providing a controlled amount of radiation to at least one longitudinal zone of said web.

24. The process of claim 10, wherein said subjecting further comprises providing a controlled amount of radiation to a plurality of longitudinal zones of said web.

25. A process for drying a web to control a moisture cross profile in the web, the process comprising:

guiding a web having a moisture content;

subjecting said web to laser radiation to remove at least some portion of said moisture content in order to control the moisture cross profile of said web, said subjecting further comprising providing a controlled amount of radiation to a plurality of longitudinal zones of said web; and varying said controlled amounts so that different zones of said web receive different amounts of radiation.

26. A process for drying a web to control a moisture cross profile in the web, the process comprising:

guiding a web having a moisture content;

subjecting said web to laser radiation to remove at least some portion of said moisture content in order to control the moisture cross profile of said web; and detecting a tear in said web and stopping said subjecting in response to said detecting.

27. A process for drying a web to control a moisture cross profile in the web, the process comprising:

guiding a web having a moisture content;

subjecting sad web to laser radiation to remove at least some portion of said moisture content in order to control the moisture cross profile of said web; and preventing said laser radiation from impacting objects other than said web.

28. A process for drying a web to control a moisture cross profile in the web, the process comprising:

guiding a web having a moisture content;

subjecting said web to laser radiation to remove at least some portion of said moisture content in order to control the moisture cross profile of said web;

measuring a moisture content of said web;

communicating said measuring to a control device; and adjusting said subjecting with said control device.

29. The process of claim 28, wherein said measuring further comprises providing a controlled amount of laser radiation to at least one longitudinal zone of said web.

30. A process for drying a fibrous material web to control a moisture cross profile in the web, the process comprising:

continuously guiding a fibrous material web having a moisture content;

measuring said moisture content;

communicating said measuring to one of a control device and an array of lasers; and subjecting said web to a controlled amount of infra-red laser radiation in order to reduce said moisture content;

monitoring said web for tearing so that said laser radiation is discontinued when a tear is detected, wherein said laser radiation is set to a frequency range which in which more energy is absorbed by said moisture than by said web.

31. A process for drying a continuous fibrous material web, comprising;

guiding said continuous fibrous material web;

subjecting said continuous fibrous material web to laser radiation;

measuring a moisture content of said web;

communicating said measured moisture content to a control device; and adjusting said subjecting with said control device.

32. The process of claim 31, wherein the web is one of a paper, tissue, and cardboard web.

33. The process of claim 31, further comprising:

setting a frequency of said laser radiation so that a moisture content of said continuous fibrous material absorbs more laser radiation than other components of said continuous fibrous material web.

34. The process of claim 31, wherein said subjecting further comprises:

separately controlling by zone a laser radiation intensity laterally across said continuous fibrous material web.

35. The process of claim 31, wherein said subjecting further comprises:

controlling an area influenced by said laser radiation in a longitudinal direction of said continuous fibrous material web.

36. The process of claim 34, wherein a reach of a radiated area of a zone is controlled laterally to said continuous fibrous material web.

37. The process of claim 31, further comprising:

switching off said laser radiation when a tear in said continuous fibrous material web is detected.

38. The process of claim 31, wherein said subjecting occurs predominantly at an end of a drying process.

39. The process of claim 31, wherein said subjecting results in evening out a moisture cross profile of said continuous fibrous material web.

40. A process for drying a continuous web comprising:

guiding a continuous web having a moisture content;

subjecting said continuous web to laser radiation to remove at least some portion of said moisture content;

measuring a moisture content of said web;

communicating said measured moisture content to a control device; and adjusting said subjecting with said control device.

41. The process of claim 40, wherein said continuous web is one of a paper, tissue, and cardboard web.

42. The process of claim 40, further comprising:

continuously guiding said continuous web; and continuously subjecting said continuous web to laser radiation.

43. The process of claim 40, further comprising determining said moisture content and controlling said laser radiation in response to said determining.

44. The process of claim 43, further comprising:

heating said moisture content to a greater extent than said continuous web.

45. The process of claim 44, wherein said heating reduces said moisture content.

46. The process of claim 43, wherein said laser radiation is infra-red radiation.

47. The process of claim 43, wherein said laser radiation is set to a wavelength of at least one of approximately 1.92 $\mu$m, 1.60 $\mu$m and 1.48 $\mu$m.

48. The process of claim 40, wherein said subjecting is performed by an array of lasers arranged laterally across a portion of said continuous web.

49. The process of claim 48, wherein said array comprises a plurality of lasers arranged in a row.

50. The process of claim 49, further comprising adjusting each laser in said row.

51. The process of claim 50, wherein said adjusting corresponds to a frequency of radiation emitted.

52. The process of claim 50, wherein said adjusting corresponds to discontinuing laser radiation.

53. The process of claim 40, wherein said subjecting further comprises providing a controlled amount of radiation to at least one longitudinal zone of said continuous web.

54. The process of claim 40, wherein said subjecting further comprises providing a controlled amount of radiation to a plurality of longitudinal zones of said continuous web.

55. The process of claim 54, further comprising:

varying said controlled amounts so that different zones of said continuous web receive different amounts of radiation.

56. The process of claim 40, further comprising:

detecting a tear in said continuous web and stopping said subjecting in response to said detecting.

57. The process of claim 40, further comprising:

preventing said laser radiation from impacting objects other than said continuous web.

58. The process of claim 40, wherein said measuring further comprises providing a controlled amount of laser radiation to at least one longitudinal zone of said continuous web.

* * * * *